United States Patent [19]

Hertzberg

[11] 4,222,146

[45] Sep. 16, 1980

[54] VACUUM CLEANERS

[76] Inventor: Samuel Hertzberg, 29 Country Club La., Pomona, N.Y. 10970

[21] Appl. No.: 974,338

[22] Filed: Dec. 29, 1978

[51] Int. Cl.[2] ..... A47L 9/04

[52] U.S. Cl. ..... 15/392; 15/42; 15/375; 15/376

[58] Field of Search ..... 15/42, 79, 376, 389, 15/390, 391, 392, 420, 375

[56] References Cited

U.S. PATENT DOCUMENTS

| | | | |
|---|---|---|---|
| 1,286,321 | 12/1918 | Hoover | 15/376 |
| 1,587,794 | 6/1926 | O'Brien | 15/375 X |
| 1,888,339 | 11/1932 | White | 15/376 |
| 3,959,847 | 6/1976 | Kaulig et al. | 15/392 X |

FOREIGN PATENT DOCUMENTS

| | | | |
|---|---|---|---|
| 2134665 | 1/1972 | Fed. Rep. of Germany | 15/42 |
| 1374420 | 11/1974 | United Kingdom | 15/42 |

*Primary Examiner*—Christopher K. Moore

[57] ABSTRACT

A vacuum cleaner with improved carpet-wall edge cleaning ability achieved by bringing a free brush roll cleaning end and its bristle tufts and beater bars into optimum proximity with the edge to be cleaned. Aligned bearing structures within which the brush roll revolves, conventionally disposed to fetter the brush roll ends, are placed so that at least one is positioned on an inner segment of the brush roll, leaving a brush roll cleaning end free, unfettered. The space vacated by the bearing structure so treated allows extension of the free brush roll cleaning end into loose abutment with the general housing material, the bristle tufts and the beater bars comparably extended. These latter members can now function closer to the edge to be cleaned, thereby performing better. Additionally, a cutout in the general housing and adjacent materials allows of further extension of the free brush roll cleaning end into space thus vacated. Bristle tufts, implanted circumferentially on the said brush roll end, can be angled outward through the vacated space to contact unimpeded as the brush roll revolves the carpet-wall edge to be cleaned.

11 Claims, 13 Drawing Figures

FIG. 1
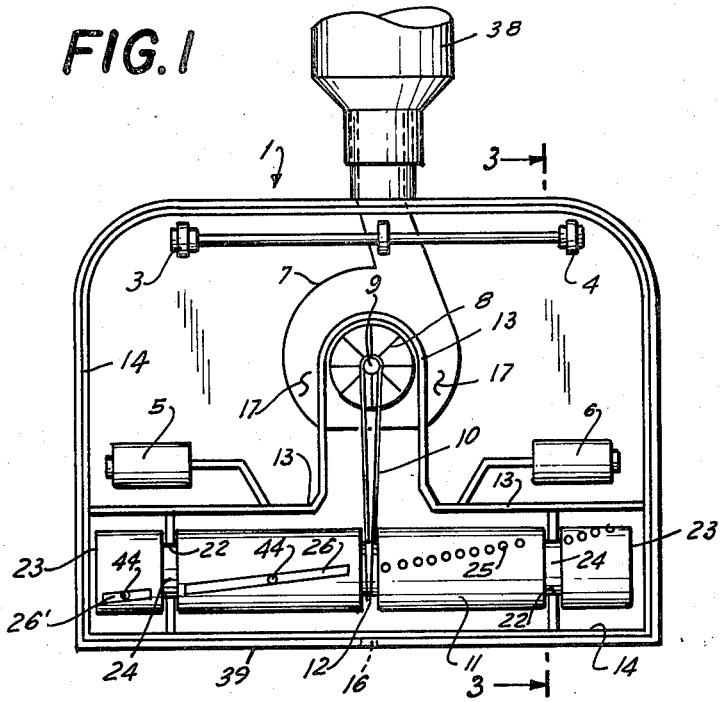
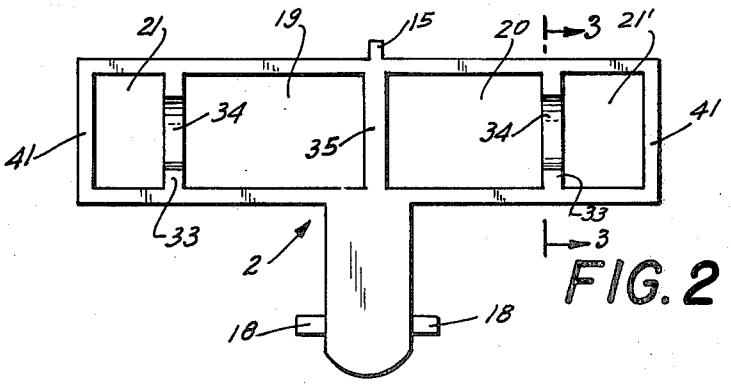
FIG. 2
FIG. 5
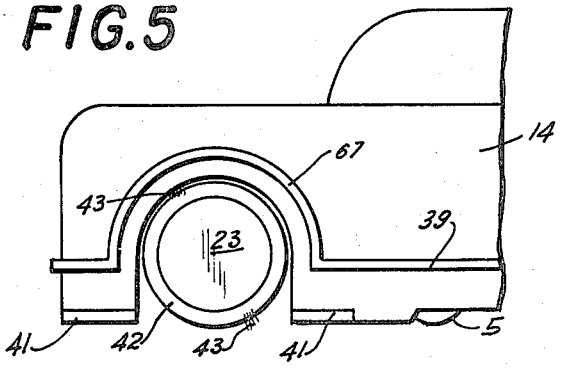

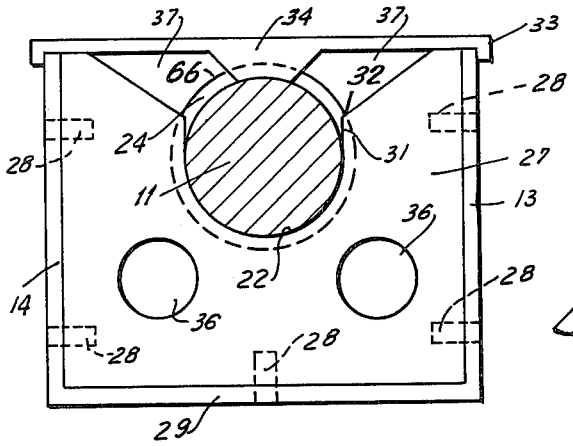
FIG. 3
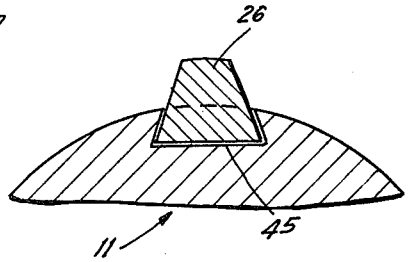
FIG. 7A
FIG. 4A
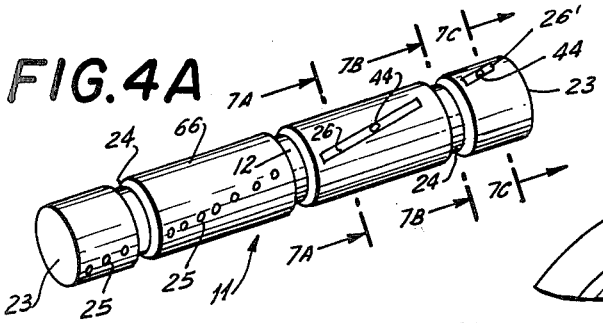
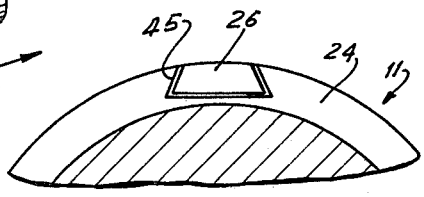
FIG. 7B
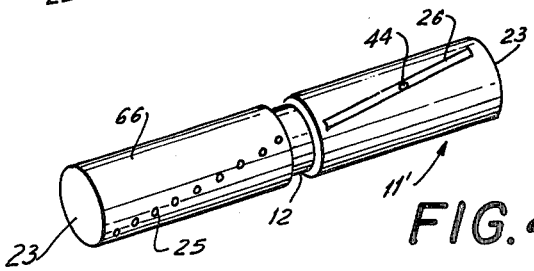
FIG. 4B
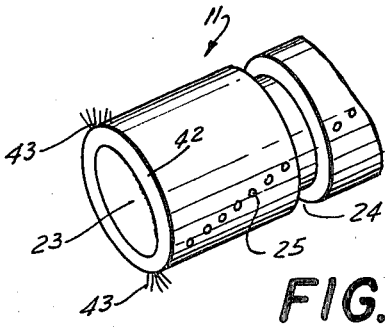
FIG. 6
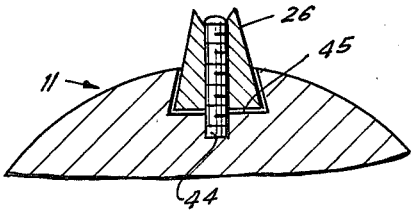
FIG. 7C

VACUUM CLEANERS

The present invention consists of improvements in vacuum cleaners designed to enhance edge cleaning ability, specifically the cleaning of an edge such as that formed by a carpet abutting a wall.

Vacuum cleaners, whether upright or cannister type, clean better when the induced vacuum is supplemented by a motor driven brush roll with bristle tufts and beater bars (which loosen groundin soil and scrub and fluff up the carpet nap). The air flow can simultaneously carry the dirt into a prepared receptacle. Contemporary models, so accoutered, are an efficient and indispensable cleaning aid.

Edge cleaning performance (compared to overall performance) is relatively poor. This is because the bristle tufts and beater bars, even in the best of current models, cannot reach into a carpet-wall edge. Intervening between them and such an edge, at the brush roll cleaning end (on which performance here depends), is up to one inch of a fettering bearing structure and the substance of a general housing and a bumper guard. Overlapping sweeps and strokes, compensating elsewhere, are here of no avail. Aside from a ripple effect (which helps), the carpet-wall edge tends to remain a repository for dirt. The use of a hand brush or the crevice tool, often indicated as palliatives, is inconvenient. It follows, therefore, that the closer to a wall the bristle tufts and the beater bars of the brush roll can be brought, the more effectively the cleaner will function at a carpet-wall edge.

Manufacturers are aware of this. They have tended to thin down the cleaner housings and the adjacent bearings structures, even the bumper guards, in order to bring the bristle tufts and the beater bars of the brush roll closer to the carpet-wall edge. Complementing this has been an improvement (in certain models advertised as having "edge cleaners") of the suction provided at the edges.

My invention embodies a novel arrangement by which at least one bearing (which in conventional models is fixed to the interior of the general housing and holds captive a brush roll cleaning end) is diverted to an inner segment of the brush roll. The brush roll cleaning end now free, unfettered, may then be extended into closer non-binding proximity with the general housing. The additional space now available at the brush roll end can be utilized to extend comparably the brush roll bristle tufts and beater bars, thereby bringing them as much as one-half inch closer to the carpet-wall edge (assuming the cleaner is positioned for edge cleaning).

The potential of the indicated new structure is, however, not exhausted. It is also feasible to effect a cutout in the general housing and adjacent members sufficient to allow the free cleaning end of the brush roll to project into and to revolve unimpeded in the vacant space. This done, one or more bristle tufts can be implanted at circumferential points on the brush roll cleaning end, angled (as the brush roll revolves) to contact a surface to be cleaned. More particularly, the angled bristle tufts may actually reach into a carpet-wall edge.

Incidental to these improvements, it should be possible to manufacture a brush roll and the related members at a saving in both materials and labor.

The accompanying drawing is a representation of my invention and, in conjunction with the description which follows, reveals how the objects, novel features and advantages are achieved.

FIG. 1 is a plan view of the interior of the general housing of an upright vacuum cleaner after the guard plate has been removed;

FIG. 2 is a plan view of the interior side of the guard plate of FIG. 1;

FIG. 3 is a section on the line 3—3 of FIG. 1 and shows how the members cooperate to form a bearing structure for the brush roll;

FIG. 4A is a view in perspective of the brush roll of FIGS. 1 and 3;

FIG. 4B is a view in perspective of a brush roll which could be used after modifying certain members of the preceding figures;

FIG. 5 is an elevational view of a portion of the exterior of the general housing of FIG. 1 adjacent to a free brush roll cleaning end and illustrates the relationship between a cutout in the general housing and bumper guard and such a brush roll end;

FIG. 6 is a view in perspective of the brush roll cleaning end of FIG. 5;

FIG. 7A is a portion of a section on the line 7A—7A of FIG. 4A and indicates treatment of a portion of a beater bar;

FIG. 7B is a portion of a section on the line 7B—7B of FIG. 4A and indicates treatment of another portion of a beater bar;

FIG. 7C is a portion of a section on the line 7C—7C of FIG. 4A and indicates treatment of yet another portion of a beater bar;

Figure 8:
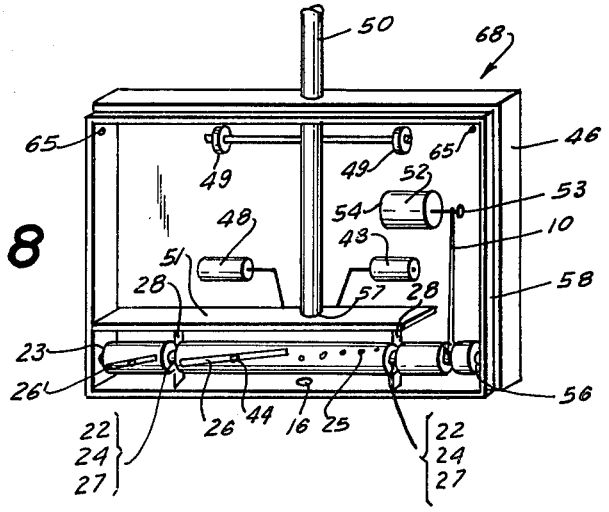
FIG. 8 is a view in perspective of the interior of the general housing of a motor driven brush roll attachment of a cannister type vacuum cleaner adapted to the purposes of my invention.

The upright vacuum cleaner 1 of FIG. 1, casually appraised, appears quite conventional. Even the structures in the interior of the general housing 14 appear much as might be expected. They include the usual members: wheels 3, 4, 5, 6; a motor housing 7; exposed air vanes 8; a drive pulley 9 enveloped by a drive belt 10; a brush roll 11 with a belt groove 12 to receive the drive belt 10 in taut linkage with the drive pulley 9; and an air control wall 13 which abuts the general housing 14 at one brush roll cleaning end 23 and generally parallels the brush roll 11 till it abuts the general housing 14 at the other brush roll cleaning end 23, veering from this path only when it reaches the motor housing 7 to encompass in its fold as well the air vanes 8, the drive pulley 9 and the drive belt 10.

It will be observed that the guard plate 2 (FIG. 2) has the same perimeter contours as the area enclosed by the air control wall 13. It is intended thereby that the guard plate 2 conform to the need to segregate the brush roll 11, the drive belt 10, the drive pulley 9 and the air vanes 8 in a common air space. Additionally, it conforms to the need to protect moving parts whose function might otherwise be impeded or which may present a safety hazard. These purposes are accomplished when the guard plate 2 is secured to the undercarriage of the general housing 14 of the cleaner 1, the tab 15 inserted in the slot 16 and the tabs 18 captured by the cam locks 17 of the motor housing 7. The openings 19, 20, 21 and 21' in the guard plate 2 are designed to permit the bristle tufts 25 and the beater bars 26 and 26' to contact the surface to be cleaned. When the cleaner 1 is activated and the brush roll 11 revolves, the air flow (carrying the loosened dirt) will be through these openings 19, 20, 21 and 21' into the common air space just described and thereafter through the air vanes 8 into the dust bag 38. The bridges 33 and 35 separate these openings 19, 20, 21 and 21' from each other. The bridge 35 protects the drive belt 10. The function of the bridges 33 will be explained in due course. Mention at the proper time will also be accorded the end bridges 41.

The brush roll 11, the yoke bearing sections 22 and related members now require careful attention. In the positioning and structuring (which makes possible free brush roll cleaning ends 23) is the key to improvements which will result in more efficient edge cleaning.

A typical brush roll is cylindrical in general configuration. It has an encircling groove in a more-or-less central segment to receive the drive belt and beater bars and bristle tufts diagonally positioned on each side of this groove. The brush roll ends are fettered (and are intended to revolve) in bearings which will be affixed to opposed interior portions of the general housing. These bearings may be permanently attached to the brush roll ends by a rod which loosely traverses the core of the brush roll and is rigidly fixed at each of its ends to a bearing cap.

An examination of FIG. 1 will reveal that the yoke bearing sections 22 of my invention are positioned well away from the brush roll cleaning ends 23 in bearing grooves 24 in the brush roll 11, the brush roll cleaning ends 23 thus left free and unfettered. The space emancipated by this expedient is used to extend the brush roll cleaning ends 23 so that they are almost in contact with the general housing 14, the bristle tufts 25 and the beater bars 26, 26' similarly extended. This should bring the enumerated members almost one-half inch closer to a carpet-wall edge being cleaned, a distinct advantage. That the space thus found and utilized at the brush roll ends 23 is balanced by a comparable loss at the bearing grooves 24 is no serious loss. The usual overlapping sweeps and strokes possible away from a carpet-wall edge will more than compensate.

Attention must now be focused at FIGS. 2, 3 and 4A. The aim is to determine how a yoke bearing section 22 and related members cooperate to provide a stable bearing structure for the brush roll 11. FIG. 3 is a section view on the line 3—3 of FIGS. 1 and 2 of a yoke bearing section 22 on a supporting bearing plate 27 as it relates to a complementing bearing section 34 supported by and integrated with a bridge 33 of the guard plate 2. The bearing plate 27 is fitted into projecting slots 28 (broken lines in FIG. 3) on each of three sides of the bearing plate 27. Two of these slots 28 are integrated with the air control wall 13; two with the opposed material of the general housing 14; and one with an interior wall 29 of the general housing 14 opposed to the guard plate 2 bridge 33. If desired, the slotted arrangement can be a continuous one. Or, if preferred, the bearing plate 27 (fixed in this position permanently) can be integrated with the enumerated members. The yoke bearing section 22 is U shaped, the semi-circle 30 dimensioned to fit loosely into the bearing groove 24 of the brush roll 11. The U arms 31 are tangential to the semi-circle 30 and (though this is not essential) are truncated at the points 32. The reason for the latter treatment will be made apparent shortly. In any event, when the guard plate 2 is secured to the undercarriage of the general housing 14, the bridge 33 is located directly over the yoke bearing section 22, while the complementing bearing section 34 (permanently integrated with the bridge 33) will seat loosely in the bearing groove 24 of the brush roll 11. The yoke bearing section 22 and the complementing bearing section 34, between them, form (in spite of the two gaps 37 visible in FIG. 3) a single bearing sufficient with an aligned companion bearing (at the other bearing groove 24) to permit controlled revolution of the brush roll 11. By itself, the bearing structure of FIG. 3 related to the bearing groove 24 of the brush roll 11 provides a means by which lateral movement (as the brush roll 11 revolves) is interdicted by immobile members in loose lateral abutment with brush roll 11 surfaces; i.e., such movement is inhibited by an immobile bearing structure in loose lateral contact with the opposed walls of the bearing groove 24. This effect is supplemented by the free and extended brush roll ends 23 loosely abutting opposed immobile material of the general housing 14. The holes 36 in the bearing plate 27 and the vacant spaces or gaps 37, fashioned between the bridge 33 and the truncated U arms 31, provide air flow passages in the bearing structure to carry the dirt from the area of the brush roll cleaning end 23 into the flow leading to the air vanes 8.

It might be advantageous, as a springboard for further development, to briefly summarize how the vacuum cleaner 1 of my invention (the members related and securely locked in place) may be expected to function. The cleaner 1, the undercarriage contacting a carpet, is activated. The air vanes 8 and the drive pulley 9 revolve. Torque from the latter is transmitted by the drive belt 10 to the brush roll 11 which revolves in its aligned bearings (each consisting of a yoke bearing section 22 and a complementing bearing section 34), positioned to allow free brush roll cleaning ends 23. The soil loosened in the carpet by the bristle tufts 25 and the beater bars 26, 26' is carried by the air flow induced by the air vanes 8 through the openings 19, 20, 21, and 21' in the guard plate 2 into the channels provided to and through the air vanes 8 into the dust bag 38. The extended free brush roll cleaning ends 23 permit bristle tufts 25 and beater bars 26, 26' function closer to the carpet-wall edge. The dirt loosened there flows from the guard plate 2 openings 21 and 21' through the holes 36 and the gaps 37 in the bearing structures to mingle with the general flow toward the air vanes 8. I must here indicate that it is feasible to have aligned bearings, one positioned to provide a free brush roll cleaning end 23 and the other positioned conventionally to provide a fettered brush roll cleaning end 23. In that event, the advantages of an extended brush roll cleaning end 23 would not accrue at the fettered brush roll cleaning end 23.

Comparable results may be achieved by modifying the brush roll 11 to conform to the configuration of the brush roll 11' of FIG. 4B. The only thing required to accomplish this is the elimination of the bearing grooves 24. However, the members comprising the bearing structure of FIG. 3 (while not altered in configuration or in basic function) would require dimensional modification to accomodate the larger circumference 66 of the brush roll 11' at the eliminated bearing grooves 24. The interdiction of lateral movement in this type of construction would depend entirely on extended brush roll cleaning ends 23 in loose lateral abutment with opposed material of the general housing 14.

It is because of this latter factor that the form of my invention initially described, that utilizing a brush roll 11, is to be preferred. It is readily adaptable to further improvment in carpet-wall edge cleaning ability. This can be achieved by means of a cutout 40 (as in FIG. 5) in the general housing 14 and the bumper guard 39, in substance contiguous to a free brush roll cleaning end 23. The adjacent bridge 41 of the guard plate 2, already trimmed laterally to accomodate to the requirements of an extended free brush roll cleaning end 23, should have the portion coextensive with the cutout 40 eliminated. The stubs of the bridge 41, on both sides of the cutout 40, should be fashioned to wrap around the substance of the general housing 14, thereby strengthening it structurally. Indeed, the material of the general housing 14 adjacent to the cutout 40 should be thickened for the same reason; there is plenty of room for this.

The indicated treatment of the bridge 41 is not mandatory. The bridge 41 could be maintained intact, but fashioned not to interfere with an extended brush roll end 23 as it revolves in vacated space. There would be no cleaning loss in either construction since it is not contemplated to place bristle tufts 25 or beater bars 26, 26' material at this point in the brush roll 11 in any event. Such members, if placed here, would be in conflict with the general housing 14 at the cutout 40 unless the latter were undesirably enlarged.

It is also conceivable that a bumper guard 39 could be positioned generally above the cutout 40. It is even possible for a cleaner 1 to be manufactured without a bumper guard 39, the latter member not being essential. I prefer the construction indicated in FIG. 5, where the eliminated portion of the bumper guard 39 is replaced by a section 67 which conforms to the configuration of the cutout 40.

No matter what the treatment of the bumper guard 39 or of the bridge 41, it is necessary that the cutout 40 eliminate sufficient of the material of the general housing 14 and adjacent structures to allow the free cleaning end 23 of the brush roll 11 to project into and to revolve unimpeded in the space thereby vacated. Preferably (though this is not mandatory) the free end 23 should not be extended beyond the capabilities of the bumper guard 39; otherwise, there is the risk of the revolving end 23 marring a wall or other surface it may contact. This limitation is not serious. It is possible to form a bevel 42 around the circumference of the brush roll end 23 and to implant bristle tufts 43 approximately at right angles to the bevel 42 as illustrated in FIGS. 5 and 6. These bristle tufts 43 should be made long enough to angle directly into a carpet-wall edge being cleaned. A comparable result can be achieved without a bevel 42 by implanting bristle tufts 43 in the brush roll end 23 (where a bevel 42 would otherwise be), providing they are comparably angled and extended. Either way the bristle tufts 43 would not snag against the general housing 14 or any other structure of the cleaner 1. And, with this construction (the utilization of bristle tufts 43), the ultimate object of my invention is realized. It is now feasible to project brush roll 11 cleaning activity directly into a carpet-wall edge.

Provision for anchoring beater bars 26, 26' and bristle tufts 25 and 43 to the brush rolls 11, 11' and 11'' (of FIGS. 8 and 10) is in the main conventional. However, some modification is necessary. And this is the subject of FIGS. 7A, 7B and 7C. For illustrative purposes, the brush roll 11 of FIG. 4A will be an additional reference here. The description, however, will be equally applicable to the brush rolls 11' and 11''.

A diagonal groove 45 on the brush roll 11 cylindrical surface, forming a wedge-shaped undercut (with the apex missing), will allow a wedge-shaped beater bar 26 strip to be inserted at the brush roll end 23. Thereafter it can be pushed along the length of the groove 45, past the bearing groove 24, to dead end near the belt groove 12, its other extremity flush with the bearing groove 24 wall nearest the belt groove 12. Similarly, the beater bar 26' will be positioned so that one extremity is flush with the other wall of the bearing groove 24 and the other extremity flush with the brush roll end 23. The configuration of the structures involved (as indicated by FIG. 7A which is a portion of a section on the line 7A—7A of FIG. 4A) demonstrates that the beater bars 26, 26' will be locked in, only the apex portions emerging from the groove 45, providing that lateral stabilization can be achieved. In cleaners presently manufactured, this is realized by the beater bar strip at one extremity coming to a dead end near the belt groove and at the other extremity coming to a dead end against the bearing cap (which fetters the brush roll end). The latter expedient cannot be utilized in my invention because of the bearing groove 24 and the free brush roll and 23 construction. Lateral movement of the beater bars 26, 26' can, however, be prevented either by glueing or by means of countersinking a bolt 44 through the beater bars 26, 26' into the substance of the brush roll 11 (as in FIG. 7C). Finally, FIG. 7B demonstrates how a beater bar 26 extremity would appear flush against a wall of the bearing groove 24, to all intensive purposes integrated with it. The beater bar 26' extremities would have exactly the same appearance, one flush with the brush roll end 23 and the other with a bearing groove 24 wall. It is to be noted that at these points the apex portion of the beater bars 26, 26' is eliminated since they would otherwise interfere with the functioning of the bridges 33 and 41 of the guard plate 2.

As for the bristle tufts 25 and 43, these might be individually implanted in the substance of the brush roll 11. Or, as respects the bristle tufts 25, they might be formed on strips and positioned in the manner prescribed for the beater bars 26, 26'.

Figure 9:
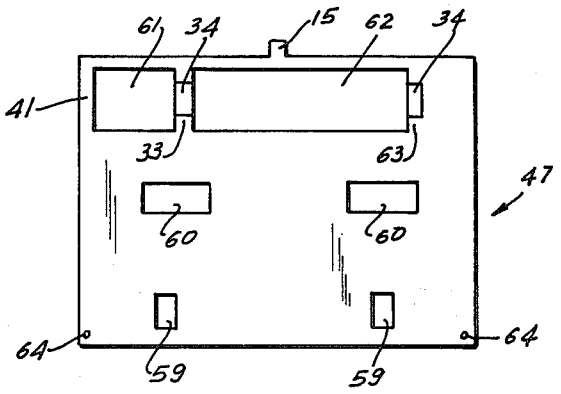
FIG. 9 is a plan view of the interior side of the guard plate to be secured to the undercarriage of the brush roll attachment of FIG. 8.
Figure 10:
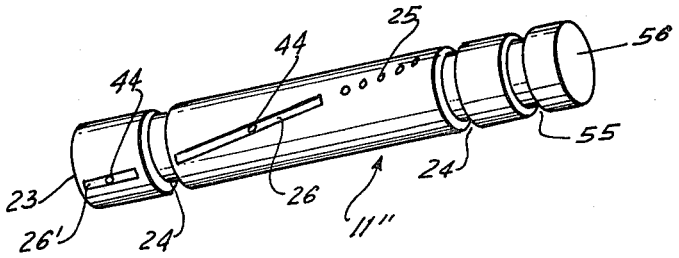
FIG. 10 is a view in perspective of the brush roll of FIG. 8.

The canister type of vacuum cleaner nowadays is likely to include a power driven brush roll attachment comparable to that employed in the upright. FIGS. 8, 9 and 10 illustrate such an attachment, the motorized brush roll structure and related members modified to suit the purposes of my invention. Parts identical with those already described will bear the same numerals and will require little if any elaboration.

FIG. 8 is a view into the interior of the general housing 46 of such an attachment 68 after the guard plate 47 has been removed from the undercarriage. Visible among the members are the wheels 48 and 49; the vacuum duct 50 leading to the cannister (which also serves as a guide wand structure); the air control wall 51 and the air port 57; the yoke bearing plates 27 and the yoke bearing sections 22 set in bearing grooves 24 of the brush roll 11''; the motor housing 52 and the drive pulley 53; and the drive belt 10 which relates the drive pulley 53 to the belt groove 55 of the brush roll 11''. It will be observed here (and in FIG. 10) that the brush roll 11'' has bristle tufts 25 and beater bars 26, 26'. Unlike the brush roll 11 (of FIG. 4A), it has only one free brush roll end 23; the other brush roll end 56, though free, has no cleaning function, merely providing a necessary shoulder for the belt groove 55. Finally, enveloping the exterior of the general housing 46 is a bumper guard 58.

The guard plate 47 (of which FIG. 9 is a view of the interior side) has openings 59 and 60 for the wheels 49 and 48; openings 61 and 62 to permit the brush roll 11'' bristle tufts 25 and beater bars 26 and 26' to contact a carpet; an end bridge 41; a bridge 33 with a complementing bearing section 34; and a bridge 63 with a complementing bearing section 34 which (unlike the bridge 33) has no opening on one side. When the guard plate 47 is fitted to the undercarriage of the general housing 46, the tab 15 will fit into the slot 16 and the holes 64 will accept bolts which can be threaded into receiving holes 65 positioned in material integrated with the general housing 46, thereby locking the guard plate 47 securely to the general housing 46.

Something must be said about the aligned bearing structures within which the brush roll 11'' will revolve. They are identical with those of FIG. 3, except that the one related to the guard bridge 63 has no holes 36 and no gaps 37 (bearing plate 27 material, bridge 63 material and complementing bearing section 34 material—between them—filling the spaces). The reason for this is the need, so far as possible, to restrict the air flow to the area encompassing the cleaning portions of the brush roll 11''. Slots 28, emanating from and integrated respectively with the air control wall 51 and the general housing 46, in a manner identical with that provided for the cleaner 1, cooperate with the bridges 33 and 63 structures to position, stabilize and lock in these bearing structures and the brush roll 11''.

The attachment 68, linked to the parent canister, may now be placed in the operating position, the exterior of the guard plate 47 contacting a carpet. The suction mechanism of the canister and the motor 54 are both activated. The drive pulley 53, the drive belt 10 and the belt groove 55 in cooperation cause the brush roll 11'' to revolve. The dirt extricated from the carpet by the bristle tufts 25 and the beater bars 26, 26' is carried by the air flow through the openings 61 and 62 in the guard plate 47 through the air port 57 in the air control wall 51 into the vacuum duct 50 leading to the cannister receptacle.

Obviously, all the advantages accruing from my invention (already described in connection with the cleaner 1) are attainable only at the free brush roll cleaning end 23 of the brush roll 11''. These include the utilization of a cutout 40 and related brush roll improvements exactly as defined in connection with FIGS. 5 and 6.

Having now described the improvements in vacuum cleaners of my invention, it must be understood that additional modifications and adaptations falling within the scope of the claims may occur to those skilled in the art.

I claim:

1. In a vacuum cleaner, a combination consisting of a general housing, a brush roll, a pair of aligned bearings, and a conforming guard plate: the brush roll revolvable subject to the application of torque supported in the general housing by the bearings, each bearing on its own supporting members on the general housing encircling the brush roll at a selected segment adjacent a respective brush roll end; at least one of the said bearings positioned sufficiently intermediate its brush roll end and the center of the brush roll to render the said brush roll end freely protruding through the bearing toward an interior surface of the general housing; a cutout in the general housing of substance contiguous to the aforementioned brush roll end sufficient to allow the brush roll end to project into and to revolve unimpeded in space formed by the said cutout; and the guard plate rigidly secured to the undercarriage of the general housing.

2. A combination according to claim 1 further characterized by the bearing related to the free brush roll end dimensioned to seat loosely in a bearing groove in the brush roll fashioned to encircle the segment of the brush roll aligned with it, said bearing and said bearing groove cooperating to form a single bearing.

3. In a vacuum cleaner, a combination consisting of a general housing, a brush roll, a pair of aligned bearings, and a conforming guard plate: the brush roll revolvable subject to the application of torque supported in the general housing by the bearings, each bearing on its own supporting members on the general housing encircling the brush roll at a selected segment adjacent a respective brush roll end; at least one of the said bearings positioned sufficiently intermediate its brush roll end and the center of the brush roll to render the said brush roll end freely protruding toward an interior surface of the general housing; the said bearing additionally consisting of a yoke bearing section integrated with and projecting from inner surfaces of the general housing and a complementing bearing section integrated with and projecting from the inner surface of a bridge in the guard plate; and the guard plate rigidly secured to the undercarriage of the general housing.

4. A combination according to claim 3 further characterized by the supporting members of the bearing related to the free brush roll end pierced by at least one air flow passage.

5. A combination according to claim 3 further characterized by the other of said bearings positioned in relation to the other brush roll end in a manner similar to that detailed for the one of said bearings and its respective brush roll end, each brush roll end extended into loose abutment with an interior surface of the general housing.

6. A combination according to claim 3 further characterized by the other of said bearings positioned in relation to the other brush roll end in a manner similar to that detailed for the one of said bearings and its respective brush roll end, each brush roll end extended into loose abutment with an interior surface of the general housing, and the supporting members of at least a single bearing pierced by at least one air flow passage.

7. A combination according to claim 3 further characterized by the bearing related to the free brush roll end dimensioned to seat loosely in a bearing groove in the brush roll fashioned to encircle the segment of the brush roll aligned with it, said bearing and bearing groove cooperating to form a single bearing.

8. A combination according to claim 3 further characterized by the bearing related to the free brush roll end dimensioned to seat loosely in a bearing groove in the brush roll fashioned to encircle the segment of the brush roll aligned with it, said bearing and bearing groove cooperating to form a single bearing, and the supporting members of the said bearing pierced by at least one air flow passage.

9. A combination according to claim 3 further characterized by the bearing related to the free brush roll end dimensioned to seat loosely in a bearing groove in the brush roll fashioned to encircle the segment of the brush roll aligned with it, said bearing and bearing groove cooperating to form a single bearing, and by a cutout in the general housing of substance contiguous to the aforementioned brush roll end sufficient to allow the brush roll end to project into and to revolve unimpeded in space formed by the said cutout.

10. A combination according to claim 3 further characterized by the bearing related to the free brush roll end dimensioned to seat loosely in a bearing groove in the brush roll fashioned to encircle the segment of the brush roll aligned with it, said bearing and bearing groove cooperating to form a single bearing, a cutout in the general housing of substance contiguous to the aforementioned brush roll end sufficient to allow the brush roll end to project into and to revolve unimpeded in space formed by the said cutout, and at least one bristle tuft implanted at a circumferential point in the brush roll end angled outward to contact unimpeded a surface to be cleaned.

11. A combination according to claim 3 further characterized by the bearing related to the free brush roll end dimensioned to seat loosely in a bearing groove in the brush roll fashioned to encircle the segment of the brush roll aligned with it, said bearing and bearing groove cooperating to form a single bearing, the supporting members of the said bearing pierced by at least one air flow passage, a cutout in the general housing of substance contiguous to the aforementioned brush roll end sufficient to allow the brush roll end to project into and to revolve unimpeded in space formed by the said cutout, and at least one bristle tuft implanted at a circumferential point in the said brush roll end angled outward to contact unimpeded a surface to be cleaned.

* * * * *